US011147404B1

(12) United States Patent
Duffy

(10) Patent No.: US 11,147,404 B1
(45) Date of Patent: Oct. 19, 2021

(54) GARMENT ORGANIZER ASSEMBLY

(71) Applicant: James Duffy, Glen Mills, PA (US)

(72) Inventor: James Duffy, Glen Mills, PA (US)

( * ) Notice: Subject to any disclaimer, the term of this patent is extended or adjusted under 35 U.S.C. 154(b) by 0 days.

(21) Appl. No.: 16/996,517

(22) Filed: Aug. 18, 2020

(51) Int. Cl.

| | |
|---|---|
| ***A47G 25/08*** | (2006.01) |
| ***A47B 61/00*** | (2006.01) |
| ***A47G 29/00*** | (2006.01) |
| ***A47B 96/16*** | (2006.01) |
| ***A47F 7/14*** | (2006.01) |
| ***A47B 43/00*** | (2006.01) |

(52) U.S. Cl.
CPC ..... *A47G 25/08* (2013.01); *A47B 43/003* (2013.01); *A47B 61/003* (2013.01); *A47B 96/16* (2013.01); *A47F 7/146* (2013.01); *A47G 29/00* (2013.01)

(58) Field of Classification Search
CPC .... A47G 25/08; A47G 29/00; A47G 25/0614; A47G 25/0621; A47G 25/0628; A47G 25/0635; A47B 61/003; A47B 43/003; A47B 43/006; A47B 43/04; A47B 43/02; A47B 96/16; A47F 7/143; A47F 7/24; A47F 7/19; A47F 7/146; A47F 1/08; A47K 10/10; D06F 57/12; A47J 47/16
USPC .... 211/85.3, 106, 106.01, 119.009, 119.011, 211/10, 11, 119.007, 119.006, 59.2, 211/119.004; 312/60, 45, 43
See application file for complete search history.

(56) References Cited

U.S. PATENT DOCUMENTS 348,164 A * 8/1886 Judson ..... A47F 1/08 312/45
1,714,469 A * 5/1929 Hoffman ..... A47F 1/08 312/45
1,928,594 A * 9/1933 Kearney ..... F25C 5/18 312/283
1,980,730 A 11/1934 Matchette
2,270,796 A 1/1942 Hauser
2,283,301 A * 5/1942 Waddell ..... A47F 5/0018 312/118
2,815,785 A 12/1957 Vail
D189,736 S * 2/1961 Combs ..... D6/517
3,007,177 A * 11/1961 Jackson ..... A47K 10/22 4/300.1
3,341,026 A * 9/1967 Spitler ..... A47B 96/16 211/88.01
3,529,877 A * 9/1970 Cassidy ..... A47K 10/22 312/34.22
3,623,250 A * 11/1971 Misenko ..... B42F 17/02 40/649
3,809,448 A * 5/1974 Rakaska ..... A47K 10/22 312/34.22
4,109,980 A * 8/1978 Brockman ..... A47F 1/08 211/59.2
4,228,743 A * 10/1980 Crook ..... A47B 47/04 108/31

(Continued)

FOREIGN PATENT DOCUMENTS

WO WO2016171861 10/2016

*Primary Examiner* — Jennifer E. Novosad

(57) ABSTRACT

A garment organizer assembly for storing garments and hats includes a pair of boxes for storing garments. Each of the boxes has a trough integrated therein for removing the garments from the boxes. Moreover, the boxes are removably attachable together having the boxes being vertically distributed. A plurality of hooks is each coupled to a respective one of the boxes to have a hat suspended thereon. A plurality of grapples is each coupled to and extends upwardly from a respective one of the boxes to engage an upper edge of a door for suspending the boxes on the door.

9 Claims, 5 Drawing Sheets

(56) References Cited

U.S. PATENT DOCUMENTS 4,775,077 A * 10/1988 Capotorto ..... A47F 1/08 221/131
5,044,522 A * 9/1991 Roig ..... A47K 3/281 222/108
5,085,328 A * 2/1992 Evenson ..... A47F 7/147 211/184
5,228,590 A * 7/1993 Blasko ..... B65D 83/02 206/504
5,333,743 A * 8/1994 Loewke ..... A47G 25/0678 211/106.01
5,361,937 A * 11/1994 Wiese ..... A47F 1/08 211/150
5,390,821 A * 2/1995 Markel ..... A47F 1/08 206/427
5,570,808 A * 11/1996 Tassoni ..... A47F 1/08 221/311
5,700,075 A * 12/1997 Perone ..... A47F 1/08 221/131
5,803,275 A * 9/1998 Schweitzer ..... B43M 99/008 211/10
5,862,943 A * 1/1999 Larit ..... A47F 1/08 221/131
5,894,940 A 4/1999 Gusdort
6,102,217 A * 8/2000 Mathy ..... A47B 87/0207 211/188
6,536,590 B1 * 3/2003 Godshaw ..... B25H 3/00 206/373
6,874,624 B2 4/2005 Redzisz
7,387,273 B1 * 6/2008 Wolfson ..... A47K 10/22 242/560.3
7,438,194 B2 * 10/2008 Wang ..... A47F 7/14 211/113
7,810,655 B2 * 10/2010 Wang ..... A47B 43/006 211/118
7,866,493 B1 * 1/2011 Hurt ..... A61B 50/10 211/119.004
7,886,916 B2 * 2/2011 Alyn ..... A47F 5/0807 211/55
8,074,812 B1 * 12/2011 Bradbury ..... A47B 49/006 211/13.1
8,439,210 B1 * 5/2013 Griffith ..... A47G 25/0614 211/119.004
8,763,818 B1 * 7/2014 Pargansky ..... A47L 17/00 211/41.3
9,687,117 B1 * 6/2017 Koch ..... A47G 29/00
10,477,984 B2 * 11/2019 Arnold ..... A47F 7/146
10,568,421 B2 2/2020 Felsenthal
2002/0071618 A1 * 6/2002 Felsenthal ..... A45C 5/04 383/39
2005/0230336 A1 * 10/2005 Mundy ..... A47G 29/08 211/113
2006/0011564 A1 * 1/2006 Hatzis ..... A47B 63/00 211/10
2006/0049124 A1 3/2006 Wang
2006/0076305 A1 * 4/2006 Wang ..... A47B 47/0075 211/113
2006/0207956 A1 9/2006 Sivers
2007/0193651 A1 * 8/2007 Kauzlarich ..... A47F 1/035 141/86
2009/0184077 A1 * 7/2009 Curet ..... A47B 43/006 211/117
2009/0188819 A1 * 7/2009 Carney, Jr. ..... A63B 71/0036 206/315.1
2010/0038330 A1 * 2/2010 Zu ..... A47F 7/146 211/90.04
2010/0027024 A1 10/2010 Rodriguez
2018/0317647 A1 11/2018 Felsenthal
2019/0038110 A1 * 2/2019 Manooki ..... A47J 47/20

* cited by examiner

GARMENT ORGANIZER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to organizer devices and more particularly pertains to a new organizer device for storing garments and hats.

(2) Description of Related Art Including Information Disclosed Under 37 CFR 1.97 and 1.98

The prior art relates to organizer devices including a garment organizer that includes a plurality of hooks that is suspended on a door. The prior art discloses a hanger attachment for suspending an object from a top edge of a door. The prior art discloses a laundry bag for storing soiled garments. The prior art discloses a garment storage device that includes a plurality of vertical members for hanging a plurality of garments thereon. The prior art discloses a garment storage device that includes a plurality of mesh pockets for storing garments. The prior art discloses a garment storage panel that includes a plurality of pockets for storing garments. The prior art also discloses hanging belt that can be suspended on a door that includes a plurality of slots for hanging a storage object thereon.

BRIEF SUMMARY OF THE INVENTION

An embodiment of the disclosure meets the needs presented above by generally comprising a pair of boxes for storing garments. Each of the boxes has a trough integrated therein for removing the garments from the boxes. Moreover, the boxes are removably attachable together having the boxes being vertically distributed. A plurality of hooks is each coupled to a respective one of the boxes to have a hat suspended thereon. A plurality of grapples is each coupled to and extends upwardly from a respective one of the boxes to engage an upper edge of a door for suspending the boxes on the door.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
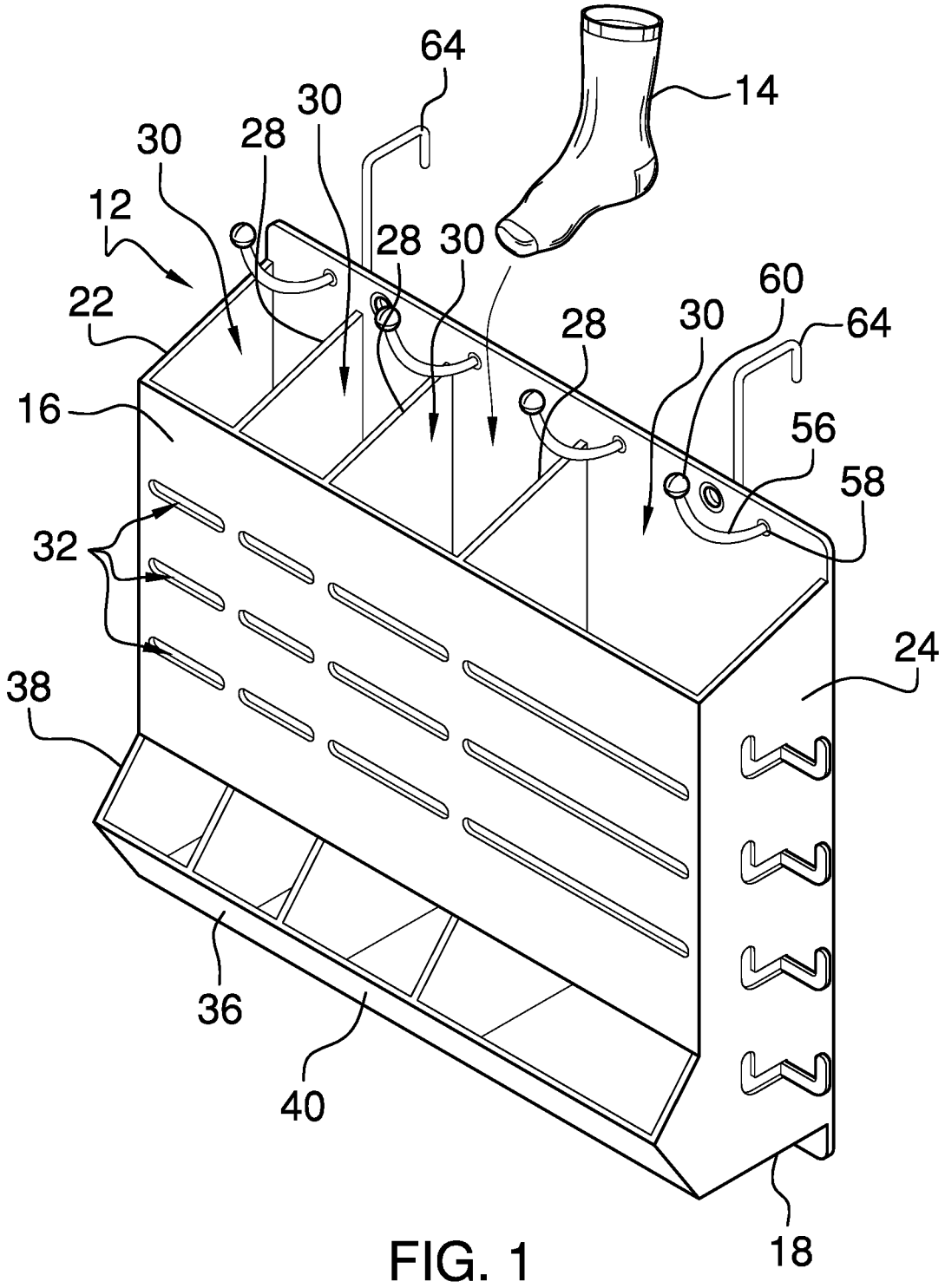
FIG. 1 is a front perspective view of a garment organizer assembly according to an embodiment of the disclosure.
Figure 2:
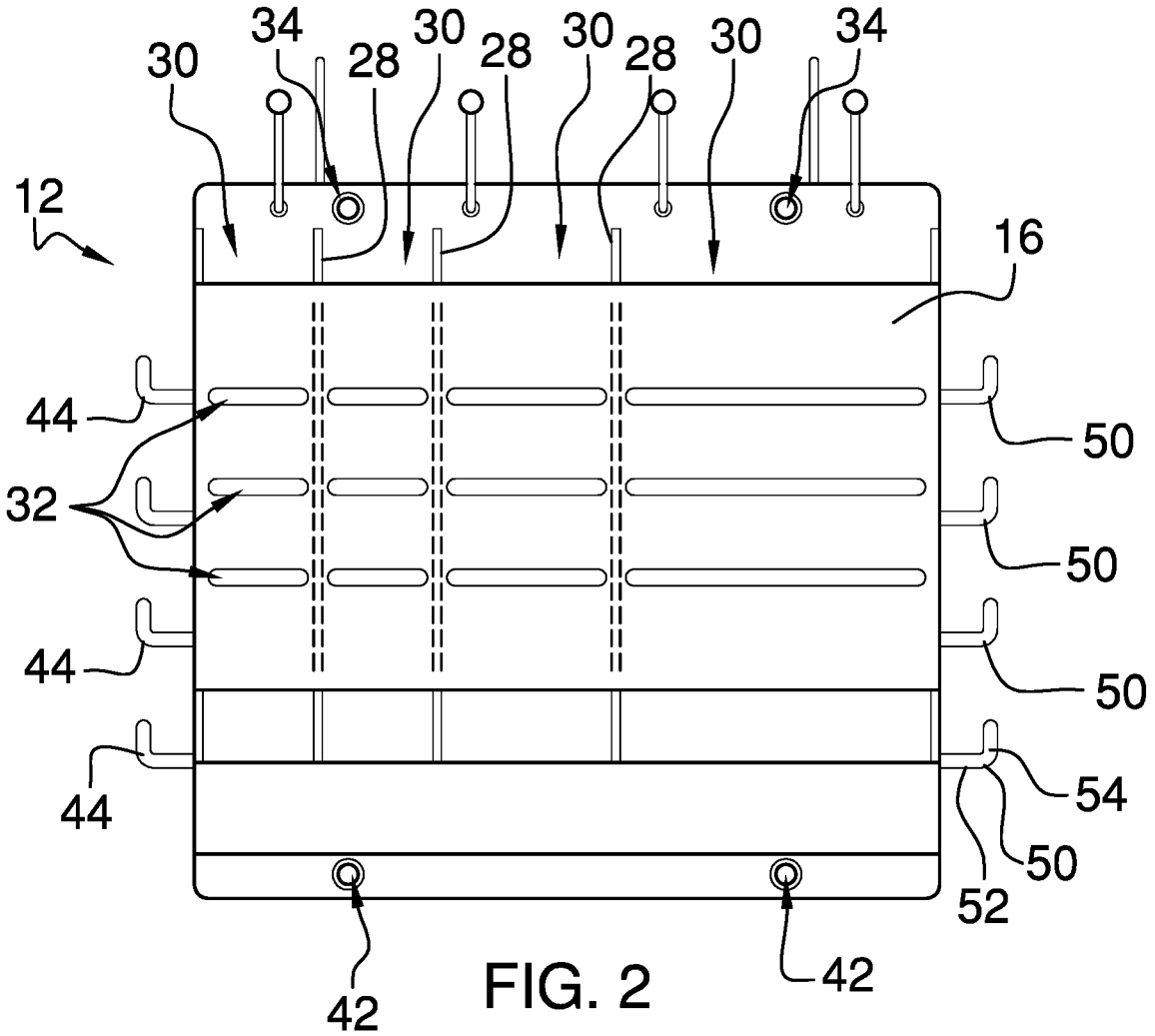
FIG. 2 is a front phantom view of an embodiment of the disclosure.
Figure 3:
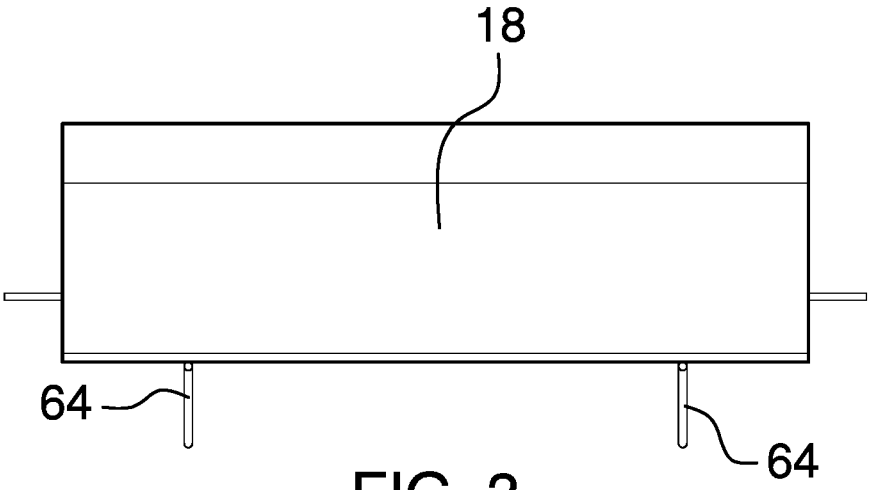
FIG. 3 is a bottom view of an embodiment of the disclosure.
Figure 4:
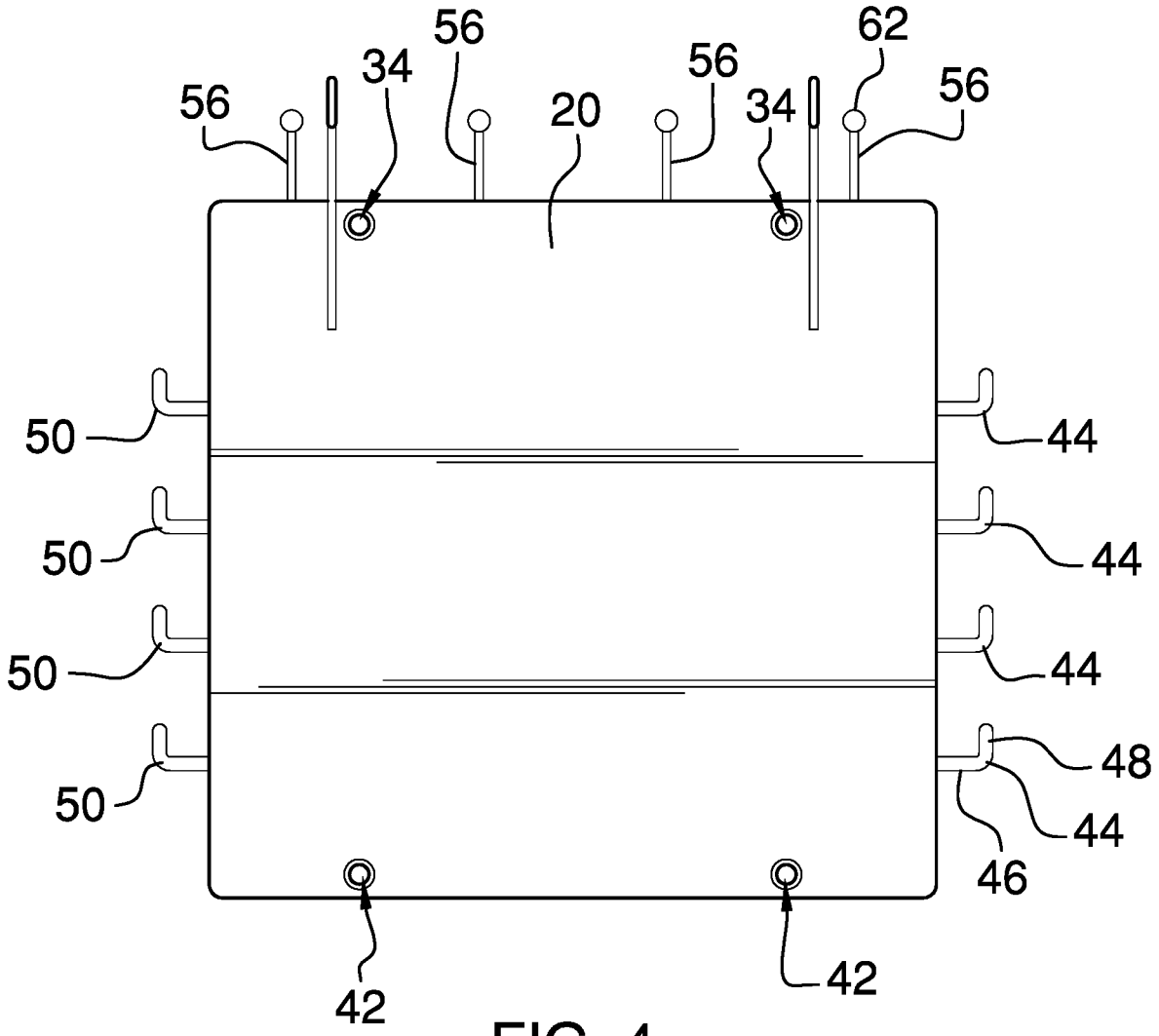
FIG. 4 is a back view of an embodiment of the disclosure.
Figure 5:
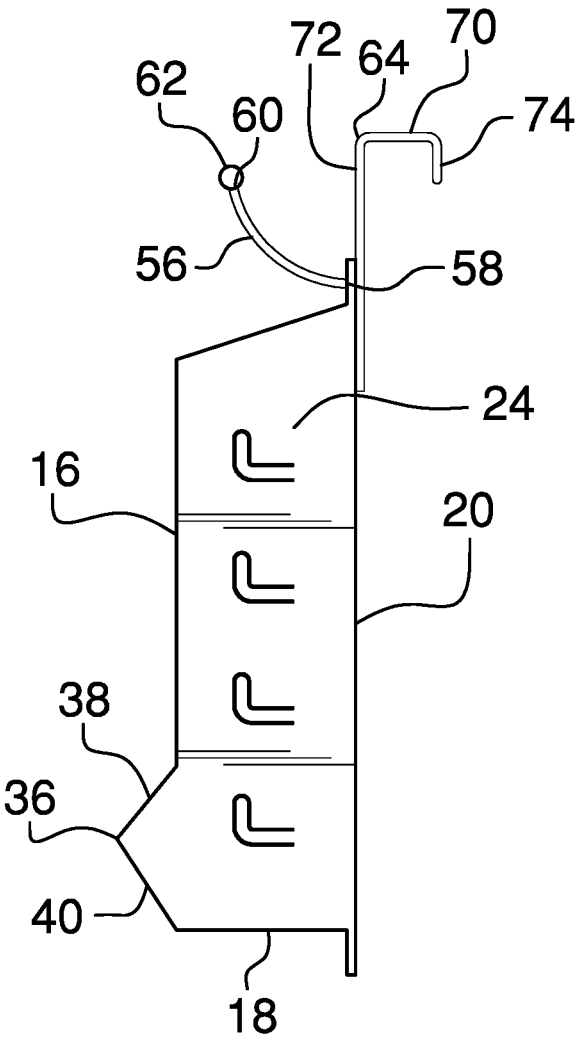
FIG. 5 is a left side view of an embodiment of the disclosure.
Figure 6:
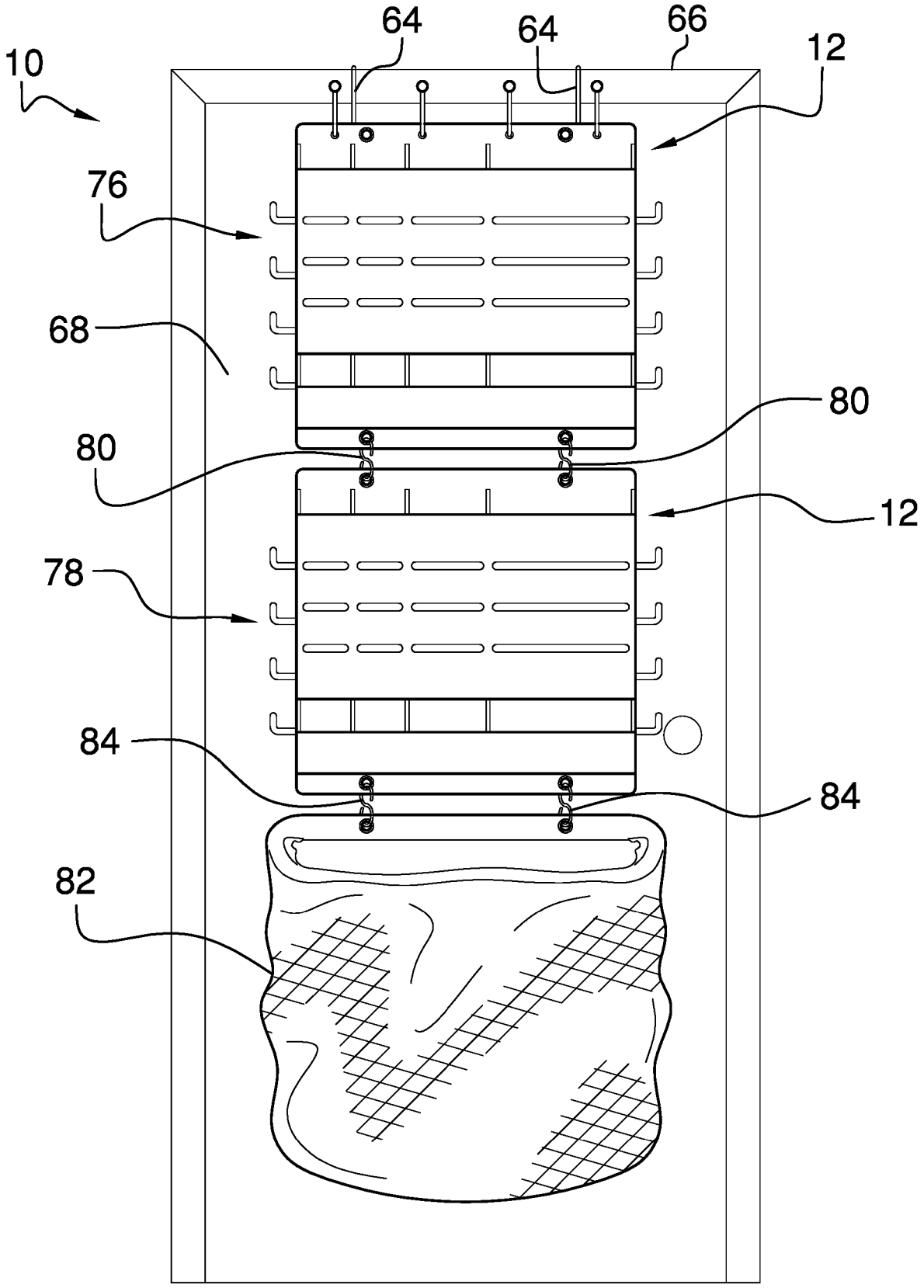
FIG. 6 is a front in-use view of an embodiment of the disclosure.

With reference now to the drawings, and in particular to FIGS. 1 through 6 thereof, a new organizer device embodying the principles and concepts of an embodiment of the disclosure and generally designated by the reference numeral 10 will be described.

As best illustrated in FIGS. 1 through 6, the garment organizer assembly 10 generally comprises a pair of boxes 12 for storing garments 14. The garments 14 may comprise socks, undergarments or other garments that typically do not requiring ironing. Each of the boxes 12 has a front wall 16, a bottom wall 18, a back wall 20, a first lateral wall 22, a second lateral wall 24 and a top side 26. The top side 26 of respective boxes is open into an interior of the respective box 12. Each of the boxes 12 has a plurality of dividers 28 each extending between the front wall 16 and the back wall 20 of respective boxes to define a plurality of compartments 30 in the respective box 12. Moreover, the dividers 28 are spaced apart from each other and are distributed between the first lateral wall 22 and the second lateral wall 24 of the respective box 12.

The front wall 16 of each of the boxes 12 has a plurality of slots 32 each extends therethrough to facilitate garments 14 in the boxes 12 to be visible. In this way a user can determine when the garments 14 in each compartment 30 have become depleted. The slots 32 in respective boxes 12 are spaced apart from each other and are vertically distributed on the front wall 16 of the respective box 12, and each of the slots 32 is aligned with a respective one of the compartments 30 in the respective box 12. The back wall 20 of respective boxes 12 extends upwardly beyond the top side 26 of the respective box 12. The back wall 20 of respective boxes 12 has a pair of first holes 34 each extending therethrough and each of the first holes 34 is positioned above the top side 26 of the respective box 12 to receive a support on a door for suspending the respective box 12 from the door.

Each of the boxes 12 has a trough 36 extending forwardly from the front wall 16 of a respective box 12. The trough 36 is open into the respective box 12 to facilitate garments 14 to be removable from the respective box 12. The trough 36 has a top end 38 that is open and a forward side 40 that is spaced from the front wall 16 of the respective box 12. The trough 36 is aligned with the bottom wall 18 of the respective box 12 and each of dividers 28 in the respective box 12 extends into the trough 36 and intersects with the forward side 40 of the trough 36. The back wall 20 of each of the boxes 12 extends downwardly beyond the trough 36. Additionally, the back wall 20 of each of the boxes 12 has a pair of second holes 42 each extending therethrough and the second holes 42 are positioned beneath the trough 36 on a respective box 12.

The first lateral wall 22 of each of the boxes 12 has a plurality of first cutouts 44 extending therethrough. The first cutouts 44 are spaced apart from each other and are distributed between the bottom wall 18 and the top side 26 of a respective box 12. Each of the first cutouts 44 has a leg 46 and a foot 48. Additionally, each of the first cutouts 44 is bendable outwardly from the first lateral wall 22 of the respective box 12 having the foot 48 on each of the first cutouts 44 being vertically oriented. In this way garments 14 can be suspended from the first cutouts 44.

The second lateral wall 24 of each of the boxes 12 has a plurality of second cutouts 50 each extending therethrough. The second cutouts 50 are spaced apart from each other and are distributed between the bottom wall 18 and the top side 26 of a respective box 12. Each of the second cutouts 50 has a leg 52 and a foot 54. Each of the second cutouts 50 is bendable outwardly from the second lateral wall 24 of the respective box 12 having the foot 54 on each of the second cutouts 50 being vertically oriented. In this way garments 14 can be suspended from each of the second cutouts 50.

A plurality of hooks 56 is each coupled to a respective one of the boxes 12 and each of the hooks 56 can have a hat suspended thereon. Each of the hooks 56 has a first end 58 and a second end 60, and the first end 58 of each of the hooks 56 is coupled to the back wall 20 of the respective box 12 having each of the hooks 56 extending toward the front wall 16 of the respective box 12. Each of the hooks 56 is positioned above a respective one of the compartments 30 in the respective box 12 and each of the hooks 56 curves upwardly between the first end 58 and the second end 60. Additionally, each of the hooks 56 has a ball 62 coupled to the second end 60 to enhance engaging the hat.

A pair of grapples 64 is each coupled to and extends upwardly from a respective box 12 to engage an upper edge 66 of a door 68 for suspending the respective box 12 on the door 68. Each of the grapples 64 comprises a middle portion 70 extending between a front portion 72 and a back portion 74. The front portion 72 extends upwardly from the back wall 20 of the respective box 12 having the middle portion 70 being horizontally oriented. Thus, the middle portion 70 rests on the upper edge 66 of the door 68 having the back portion 74 extending downwardly on the door 68. The pair of boxes 12 includes a first box 76 and a second box 78, and each of the grapples 64 is positioned on the first box 76. Each of the second holes 42 in the first box 76 receives a coupler 80 that engages a respective one of the first holes 34 in the second box 78 for suspending the second box 78 from the first box 76. As is most clearly shown in FIG. 6, a bag 82 is provided, possibly comprised of a mesh material, for receiving soiled garments. The bag 82 can be suspended with couplers 84 that engage each of the second holes 74 in the second box 78.

In use, second box 78 is suspended from the first box 76 and the first box 76 is suspended on the door 68. The garments 14 are placed into respective compartments 30 in the respective first box 76 and second box 78 for storage. Each of the first cutouts 44 and the second cutouts 50 can be bent outwardly for hanging garments 14 thereon. Hats, or any other garment, can be suspended on each of the hooks 56. The slots 32 in each of the boxes 12 facilitate the level of garments 14 in each compartment 30 in each of the boxes 12 to be visible. Moreover, each of the garments 14 can be retrieved through the trough 36 in each of the boxes 12 for use and the slots 32 facilitate the level of garments 14 in each compartment 30 in each box 12 to be visible.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A garment organizer assembly for storing accessory garments on a door, said assembly comprising:

a pair of boxes for storing garments, each of said boxes having a trough being integrated therein for removing the garments from said boxes, said boxes being removably attachable together having said boxes being vertically distributed;

a plurality of hooks, each of said hooks being coupled to a respective one of said boxes wherein each of said hooks is configured to have a hat suspended thereon;

a plurality of grapples, each of said grapples being coupled to and extending upwardly from a respective one of said boxes wherein each of said grapples is configured to engage an upper edge of a door for suspending said boxes on the door;

wherein each of said boxes has a front wall, a bottom wall, a back wall, a first lateral wall, a second lateral wall and a top side, said top side of each of said boxes being open into an interior of said boxes, each of said boxes having a plurality of dividers each extending between said front wall and said back wall to define a plurality of compartments in said boxes, said dividers in respective boxes being spaced apart from each other and being distributed between said first lateral wall and said second lateral wall of said respective box; and wherein said trough in respective boxes extends forwardly from said front wall of said respective box, said trough in each of said boxes being open into said respective box, wherein said trough is configured to facilitate garments to be removable from said respective box, said trough in each of said boxes having a top end being open and a forward side being spaced from said front wall of said respective box, said trough in each of said boxes being aligned with said bottom wall of said respective box, each of dividers in said respective box extending into said trough in said respective box and intersecting with said forward side of said trough in said respective box.

2. The assembly according to claim 1, wherein said front wall of each of said boxes has a plurality of slots each extending therethrough, wherein each of said slots is configured to facilitate garments in said boxes to be visible, said slots in respective boxes being spaced apart from each other and being vertically distributed on said front wall of said respective box, each of said slots being aligned with a respective one of said compartments in said respective box.

3. The assembly according to claim 1, wherein said back wall of respective boxes extends upwardly beyond said top side of said respective box, said back wall of each of said boxes having a pair of holes each extending therethrough, each of said holes in respective boxes being positioned above said top side of said respective box.

4. The assembly according to claim 1, wherein each of said hooks has a first end and a second end, said first end of each of said hooks being coupled to said back wall of said respective box having each of said hooks extending toward said front wall of said respective box, each of said hooks being positioned above a respective one of said compartments in said respective box, each of said hooks curving upwardly between said first end and said second end.

5. The assembly according to claim 4, wherein each of said hooks has a ball being coupled to said second end wherein said ball on each of said hooks is configured to enhance engaging the hat.

6. The assembly according to claim 1, wherein each of said grapples comprises a middle portion extending between a front portion and a back portion, said front portion extending upwardly from said back wall of said respective box having said middle portion being horizontally oriented, wherein said middle portion is configured to rest on the upper edge of the door having said back portion extending downwardly on the door.

7. A garment organizer assembly for storing accessory garments on a door, said assembly comprising:

a pair of boxes for storing garments, each of said boxes having a trough being integrated therein for removing the garments from said boxes, said boxes being removably attachable together having said boxes being vertically distributed;

a plurality of hooks, each of said hooks being coupled to a respective one of said boxes wherein each of said hooks is configured to have a hat suspended thereon;

a plurality of grapples, each of said grapples being coupled to and extending upwardly from a respective one of said boxes wherein each of said grapples is configured to engage an upper edge of a door for suspending said boxes on the door;

wherein each of said boxes has a front wall, a bottom wall, a back wall, a first lateral wall, a second lateral wall and a top side, said top side of each of said boxes being open into an interior of said boxes, each of said boxes having a plurality of dividers each extending between said front wall and said back wall to define a plurality of compartments in said boxes, said dividers in respective boxes being spaced apart from each other and being distributed between said first lateral wall and said second lateral wall of said respective box; and wherein said first lateral wall of each of said boxes has a plurality of first cutouts extending therethrough, said first cutouts on respective boxes being spaced apart from each other and being distributed between said bottom wall and said top side of said respective box, each of said first cutouts having a leg and a foot, each of said first cutouts being bendable outwardly from said first lateral wall having said foot on each of said first cutouts being vertically oriented wherein each of said first cutouts is configured to have garments hung thereon.

8. The assembly according to claim 7, wherein said second lateral wall of each of said boxes has a plurality of second cutouts extending therethrough, said second cutouts on respective boxes being spaced apart from each other and being distributed between said bottom wall and said top side of said respective box, each of said second cutouts having a leg and a foot, each of said second cutouts being bendable outwardly from said second lateral wall of said respective box having said foot on each of said second cutouts being vertically oriented wherein each of said second cutouts is configured to have garments hung thereon.

9. A garment organizer assembly for storing accessory garments on a door, said assembly comprising:

a pair of boxes for storing garments, each of said boxes having a trough being integrated therein for removing the garments from said boxes, said boxes being removably attachable together having said boxes being vertically distributed, each of said boxes has a front wall, a bottom wall, a back wall, a first lateral wall, a second lateral wall and a top side, said top side of each of said boxes being open into an interior of said boxes, each of said boxes having a plurality of dividers each extending between said front wall and said back wall to define a plurality of compartments in said boxes, said dividers in respective boxes being spaced apart from each other and being distributed between said first lateral wall and said second lateral wall of said respective box, said front wall of each of said boxes has a plurality of slots each extending therethrough, wherein each of said slots is configured to facilitate garments in said boxes to be visible, said slots in respective boxes being spaced apart from each other and being vertically distributed on said front wall of said respective box, each of said slots being aligned with a respective one of said compartments in said respective box, said back wall of respective boxes extends upwardly beyond said top side of said respective box, said back wall of each of said boxes having a pair of holes each extending therethrough, each of said holes in respective boxes being positioned above said top side of said respective box, said trough in respective boxes extends forwardly from said front wall of said respective box, said trough in each of said boxes being open into said respective box wherein said trough is configured to facilitate garments to be removable from said respective box, said trough in each of said boxes having a top end being open and a forward side being spaced from said front wall of said respective box, said trough in each of said boxes being aligned with said bottom wall of said respective box, each of dividers in said respective box extending into said trough in said respective box and intersecting with said forward side of said trough in said respective box, said first lateral wall of each of said boxes has a plurality of first cutouts extending therethrough, said first cutouts on respective boxes being spaced apart from each other and being distributed between said bottom wall and said top side of said respective box, each of said first cutouts having a leg and a foot, each of said first cutouts being bendable outwardly from said first lateral wall having said foot on each of said first cutouts being vertically oriented wherein each of said first cutouts is configured to have garments hung thereon, said second lateral wall of each of said boxes has a plurality of second cutouts extending therethrough, said second cutouts on respective boxes being spaced apart from each other and being distributed between said bottom wall and said top side of said respective box, each of said second cutouts having a leg and a foot, each of said second cutouts being bendable outwardly from said second lateral wall of said respective box having said foot on each of said second cutouts being vertically oriented wherein each of said second cutouts is configured to have garments hung thereon;

a plurality of hooks, each of said hooks being coupled to a respective one of said boxes wherein each of said hooks is configured to have a hat suspended thereon, each of said hooks has a first end and a second end, said first end of each of said hooks being coupled to said back wall of said respective box having each of said hooks extending toward said front wall of said respective box, each of said hooks being positioned above a respective one of said compartments in said respective box, each of said hooks curving upwardly between said first end and said second end; and a pair of grapples, each of said grapples being coupled to and extending upwardly from a respective one of said boxes wherein each of said grapples is configured to engage an upper edge of a door for suspending said boxes on the door, each of said grapples comprising a middle portion extending between a front portion and a back portion, said front portion extending upwardly from said back wall of said respective box having said middle portion being horizontally oriented, wherein said middle portion is configured to rest on the upper edge of the door having said back portion extending downwardly on the door.

* * * * *